US008230525B2

(12) United States Patent
Lambertz

(10) Patent No.: US 8,230,525 B2
(45) Date of Patent: Jul. 31, 2012

(54) SOCK

(75) Inventor: Bodo W. Lambertz, Pfaffikon (CH)

(73) Assignee: X-Technology Swiss GmbH, Wollerau (CH)

( * ) Notice: Subject to any disclaimer, the term of this patent is extended or adjusted under 35 U.S.C. 154(b) by 458 days.

(21) Appl. No.: 11/991,891

(22) PCT Filed: Aug. 30, 2006

(86) PCT No.: PCT/EP2006/008471

§ 371 (c)(1),
(2), (4) Date: May 29, 2008

(87) PCT Pub. No.: WO2007/031195

PCT Pub. Date: Mar. 22, 2007

(65) Prior Publication Data

US 2009/0113602 A1 May 7, 2009

(30) Foreign Application Priority Data

Sep. 12, 2005 (DE) ..... 10 2005 043 541

(51) Int. Cl.
*A41B 11/00* (2006.01)
*A43B 17/00* (2006.01)

(52) U.S. Cl. ..... 2/239; 2/267

(58) Field of Classification Search ..... 2/239, 240, 2/241, 409, 267; 66/182, 178 R; 602/14, 602/23, 27, 65

See application file for complete search history.

(56) References Cited

U.S. PATENT DOCUMENTS 3,003,154 A * 10/1961 Litman ..... 2/239
3,545,107 A * 12/1970 Cinquegrana et al. ..... 36/50.1
4,179,826 A * 12/1979 Davidson ..... 36/69
4,325,380 A * 4/1982 Malkin ..... 36/140
4,385,456 A * 5/1983 Livernois et al. ..... 36/115
4,559,722 A * 12/1985 Norton ..... 36/89
4,811,727 A * 3/1989 Etienne ..... 602/23
4,841,957 A * 6/1989 Wooten et al. ..... 602/27
D304,876 S * 12/1989 Brown et al. ..... D2/969
5,092,347 A * 3/1992 Shaffer et al. ..... 128/892
5,133,088 A * 7/1992 Dunlap ..... 2/241
5,135,473 A * 8/1992 Epler et al. ..... 602/62
5,185,000 A * 2/1993 Brandt et al. ..... 602/63
5,211,672 A * 5/1993 Andujar ..... 36/106
5,307,522 A * 5/1994 Throneburg et al. ..... 2/239
5,620,413 A * 4/1997 Olson ..... 602/65
5,722,187 A * 3/1998 Pamio et al. ..... 36/88
D395,943 S * 7/1998 Hewett et al. ..... D2/969
D419,757 S * 2/2000 von Conta et al. ..... D2/970
D424,290 S * 5/2000 Lamprou ..... D2/969
6,286,151 B1 * 9/2001 Lambertz ..... 2/239
6,305,031 B1 * 10/2001 White ..... 2/455

(Continued)

FOREIGN PATENT DOCUMENTS

DE 2547809 * 4/1977

(Continued)

*Primary Examiner* — Alissa L Hoey

(74) *Attorney, Agent, or Firm* — Olson & Cepuritis, Ltd.

(57) ABSTRACT

This invention relates to a sock for use in sports activities. The sock, includes cushioning in the area of the Achilles tendon for absorbing frictional and impact stresses without force being applied to the Achilles tendon. In one embodiment, the cushioning comprises elongated vertically spaced apart cushions that are in a bent shape. In another embodiment the cushioning comprises vertically spaced apart cushions that are divided by a vertically oriented ridge.

7 Claims, 2 Drawing Sheets

U.S. PATENT DOCUMENTS

| | | | | |
|---|---|---|---|---|
| 6,826,853 | B1 * | 12/2004 | Zanatta | 36/131 |
| D548,444 | S * | 8/2007 | Covatch et al. | D2/970 |
| D581,057 | S * | 11/2008 | Lin et al. | D24/192 |
| 7,681,254 | B2 * | 3/2010 | Lambertz | 2/239 |
| 2002/0083622 | A1 * | 7/2002 | Joubert et al. | 36/117.6 |
| 2004/0049951 | A1 * | 3/2004 | Chen | 36/93 |
| 2005/0091729 | A1 * | 5/2005 | Alley | 2/239 |
| 2005/0108800 | A1 * | 5/2005 | White | 2/2.5 |
| 2005/0144703 | A1 * | 7/2005 | Hilbert | 2/239 |
| 2005/0165340 | A1 * | 7/2005 | Dunn et al. | 602/27 |
| 2005/0241189 | A1 * | 11/2005 | Elkington et al. | 36/117.6 |
| 2006/0130217 | A1 * | 6/2006 | Lambertz | 2/239 |
| 2006/0143801 | A1 * | 7/2006 | Lambertz | 2/239 |
| 2006/0195971 | A1 * | 9/2006 | Lambertz | 2/239 |
| 2007/0033710 | A1 * | 2/2007 | Lambertz | 2/239 |
| 2007/0118973 | A1 * | 5/2007 | Lambertz | 2/239 |
| 2007/0256215 | A1 * | 11/2007 | Lambertz | 2/239 |
| 2009/0005717 | A1 * | 1/2009 | Brzank | 602/65 |
| 2009/0293179 | A1 * | 12/2009 | Hasan | 2/409 |
| 2010/0043124 | A1 * | 2/2010 | Arakelian et al. | 2/239 |
| 2010/0168631 | A1 * | 7/2010 | Scheffer et al. | 602/27 |

FOREIGN PATENT DOCUMENTS

| | | | |
|---|---|---|---|
| DE | 10305277 | A1 * | 9/2003 |
| EP | 1897456 | * | 3/2008 |
| FR | 2607383 | A1 * | 6/1988 |
| FR | 2808661 | * | 11/2001 |
| JP | 2003088545 | * | 3/2003 |
| WO | WO 2004043176 | * | 5/2004 |
| WO | WO 2005039335 | * | 5/2005 |

* cited by examiner

SOCK

RELATED APPLICATION

This application is the National Stage of International Application No. PCT/EP2006/008471, filed Aug. 30, 20006, which is incorporated herein by reference.

BACKGROUND OF THE INVENTION

The invention relates to a sock, particularly for use in sports activities, which presents a cushioning in the form of at least two cushions in the area of the Achilles tendon.

People wear solid footwear on their feet, particularly in sports activities. In addition, the feet are frequently enclosed in socks. As a result of frequent rapid movements in sports activities, there is increased friction between the foot and the shoe, associated with dynamic impact stresses. The area of the protruding Achilles tendon is particularly affected. The generally hard edge of the shoe shaft, which, depending on the footwear, may be applied at different heights against the Achilles tendon, can also result in extreme strong stress points due to the application of frictional and impact stresses. This can lead to premature fatigue of the foot, as well as to abrasions including injury of the Achilles tendon.

To reduce the friction as well as the impact, and thus to prevent abrasions and injuries to the Achilles tendon, it is known, among other procedures (see DE 297 15 762 U1), to protect the Achilles tendon by providing a cushion. To avoid the occurring frictional and impact stresses on the Achilles tendon, it is also known (see DE 202 17 332 U1), to provide two separating cushions, which are arranged on both sides along the Achilles tendon. The known cushions fulfill their intended purpose. However, they present the drawback that, because of the additional material to be processed, the freedom of movement of the foot in the area of the Achilles tendon is restricted. Furthermore, the additional material to be processed leads to heat insulation, which is undesirable, because controlling the climate in socks is of great importance particularly in sports activities with regard to the prevention of premature fatigue and the risk of blister formation.

BRIEF SUMMARY OF THE INVENTION

Here, the invention provides a remedy. The invention is based on the problem of ensuring, while providing protection for the Achilles tendon, on the one hand, the mobility in the area of the Achilles tendon, and, on the other hand, an improvement of the climate control in the area of the Achilles tendon. According to the invention, this problem is solved by forming between the cushions a respective, substantially horizontally extending joint.

The invention provides a sock, particularly for sports activities, which further improves the protection of the Achilles tendon in the shoe. The joint provided between the cushions improves the mobility in the area of the Achilles tendon, while continuing to provide protection for the Achilles tendon, because the sock presents "predetermined bending points" in a manner of speaking, in the area of the heel. In addition, it is possible to improve the climate control in the area of the Achilles tendon, because, on the one hand, additional material for protecting the Achilles tendon is not used on a continuous basis, and, on the other hand, the joints assume the functions of aeration and ventilation channels.

The cushions advantageously present a bent shape. As a result, a very good protection from the footwear that surrounds the sock is provided, while at the same time causing a uniform pressure distribution.

In a variant of the invention, the cushions are divided by a vertically oriented ridge (26). By means of the ridge, which is in a retracted position with respect to the cushions, the cushions are held on the side of the Achilles tendon in an optimal position. In addition, a separation is achieved between the Achilles tendon and the shoe, which makes it possible to keep frictional and impact stresses away from the Achilles tendon.

In an additional embodiment of the invention, the ridge is designed in the shape of a cushion, which presents a smaller thickness than the cushions. Due to the additional cushioning of the ridge, the protection of the Achilles tendon is increased further. On the one hand, the smaller thickness of the ridge ensures that the separating cushions maintain their position reliably on both sides of the Achilles tendon, even in extreme sports activities. On the other hand, the Achilles tendon itself is protected additionally by the cushioning of the rod against frictional and impact stresses.

In another embodiment of the invention, the shapes of the cushions are adapted to the anatomical shape of the foot in the area of the Achilles tendon. As a result, the absorption of dynamic impact stress is optimized by the cushioning, and stress application to the Achilles tendon is minimized.

Other variants and embodiments of the invention are indicated in the remaining dependent claims.

BRIEF DESCRIPTION OF THE DRAWING

An embodiment example of the invention is represented in the drawing and described in detail below. In the drawing.

DETAILED DESCRIPTION OF THE INVENTION

Figure 1:
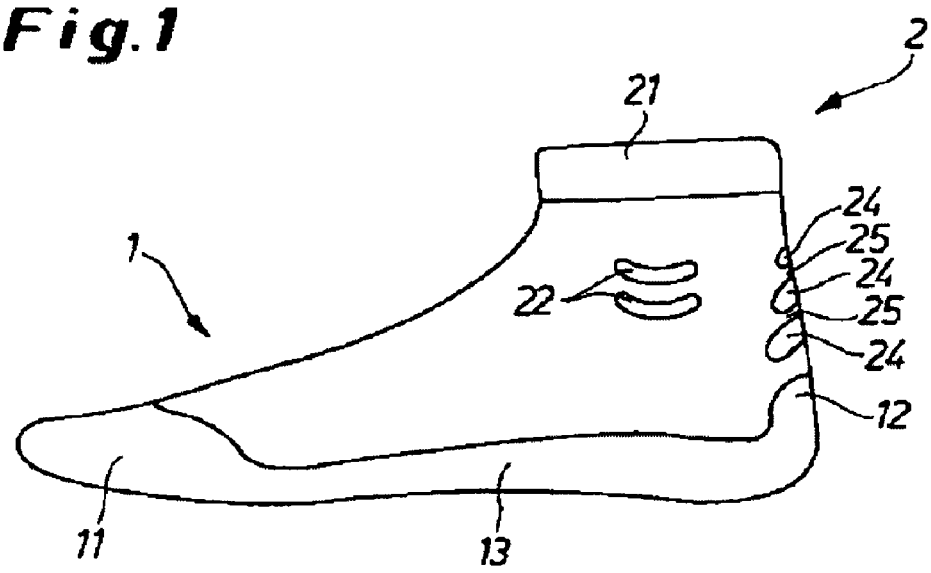
FIG. 1 shows a sock with the view of the exterior of the foot.

The sock chosen as embodiment example consists of a foot part 1 and a shaft 2. The foot part 1 presents a toe area 11, a heel area 12, and a step area 13, which is located between the toe area and the heel area. The areas 11, 12 and 13, as represented in the embodiment example, can be made of reinforced material. It is also possible to use material combinations, such as, for example, virgin wool with elastofiber materials, for example, elastane. The arrangement of additional cushions or paddings in the mentioned areas is also possible.

The shaft 2 is provided with a band 21, at its end which is turned away from the foot part 1. In the area of the ankle, the shaft 2 is provided with cushions 22, where, in the represented example, cushions 22 are provided in the direction of the band 21; other forms of cushions—for example, stab paddings—are possible.

Figure 2:
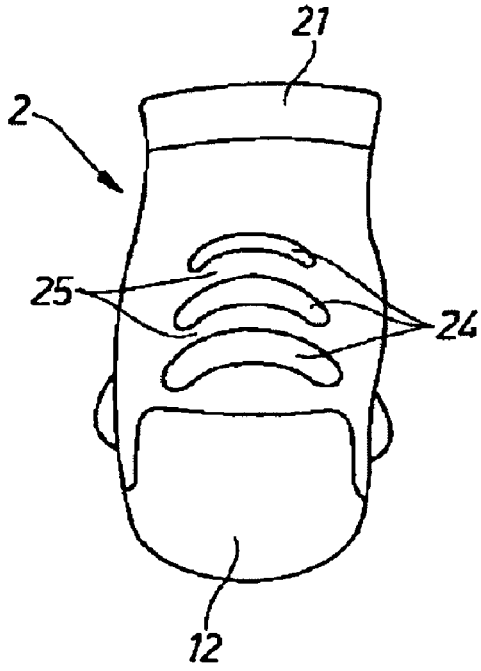
FIG. 2 shows the view of the sock represented in FIG. 1 from behind.

In the area of the Achilles tendon, a cushioning is provided. The cushioning is formed from at least two cushions 24; in the embodiment example according to FIGS. 1 and 2, the cushioning is formed from three cushions 24. The cushions 24, in this embodiment, have a bent shape and they each present different dimensions. The cushions 24 are here bent in the direction of the heel area 12. The outermost ends of the cushions 24 are bent down in the direction of the heel area 12, into an area which is located under the highest point of the adjacent cushion 24. As a result, a very good protection of the sock against the surrounding footwear is produced, and a uniform pressure distribution is achieved. The cushion 24 which is adjacent to the heel area 12 has the largest dimensions of all the cushions 24. The shape of the joints 25 is a function of the shape of the cushions 24.

Figure 3:
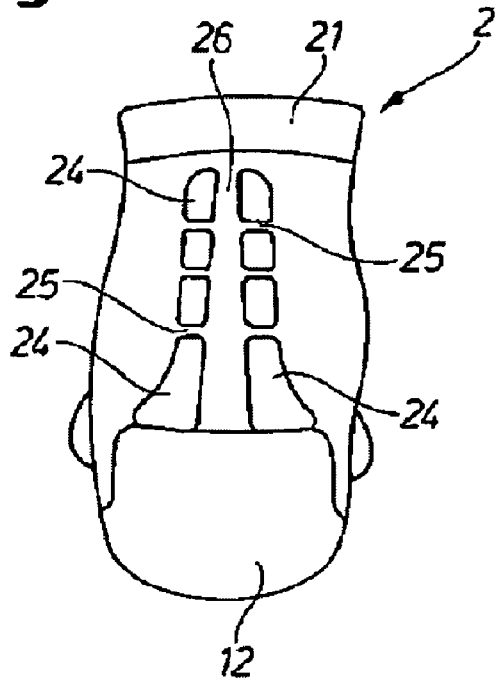
FIG. 3 shows the view of a sock from behind in a different embodiment.
Figure 4:
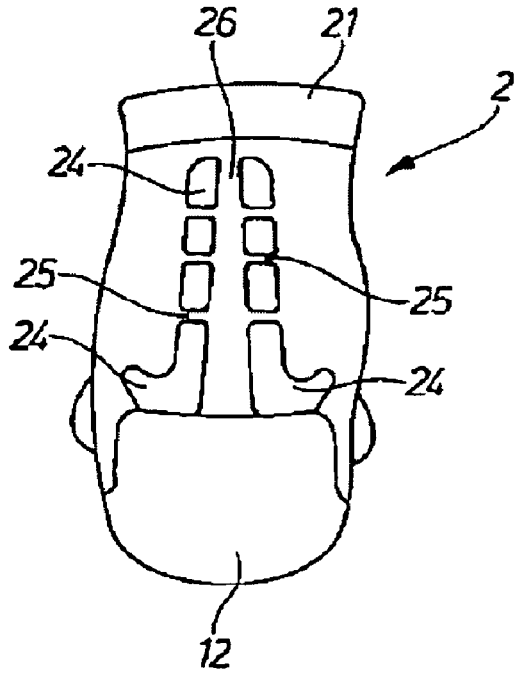
FIG. 4 shows the view of a sock from behind in another embodiment.

In the embodiment example according to FIGS. 3 and 4, the shape of the cushions 24 is adapted to the anatomy of the foot in the area of the Achilles tendon. The cushions 24 begin in the heel area 12 and they end, as they converge to a tip, in the area of the band 21. The cushions 24 which are adjacent to the heel area 12 extend with their lateral ends into the recess of the foot, which is formed between the Achilles tendon and the ankle, which results in a very good support of the foot in the shoe.

In the embodiment examples according to FIGS. 3 and 4, between the cushions 24, a joint 25 is provided, which is substantially horizontal in extension. Moreover, in the embodiment examples according to FIGS. 3 and 4, the cushions 24 are divided by a vertically oriented ridge 26. The ridge 26 also runs between the heel area 12 and the band 21, which receives the Achilles tendon. The cushions 24 are here designed in such a way that they protrude with respect to the ridge 26. This ensures that the Achilles tendon is at a sufficient separation from the enclosing footwear. Frictional and impact stresses are absorbed directly by the cushions 24, without any force being applied to the Achilles tendon. The ridge 26 can also be formed in the shape of a cushion, which presents a smaller thickness than the adjacent cushions 24.

It will be understood that the cushions 24 in the embodiments of FIGS. 1 and 2 and 3 and 4, respectively, provide cushion means for absorbing frictional and impact stresses, without force being applied to the Achilles tendon.

Moreover, the sock can be provided with a X-Cross bandage—not shown—, which is formed from an elastic, climate-regulating, fabric. The X-Cross bandage supports the ankle in the transitional area between the leg and the foot.

In addition, the sock can be provided with an air channel—not shown—, which extends as a rule from the step area 13 to the band 21, and which is formed from climate-regulating knitted fabric. The air channel contributes to removing-humidity upward, out of the step area. Such an air channel can also be provided on the inner and outer leg sides on the sock.

The cushions are generally manufactured from plastic yarns, or compound fabrics or yarns, or similar materials. In the embodiment example, the paddings of the sock are made from hollow fibers, around which wool or cotton is spun. The hollow plastic yarns provide particularly strong shock and pressure damping. The step area 13 can be manufactured from a microfiber knitted fabric, which helps to reduce abrasion. In the toe and heel area the foot bed is manufactured from microfibers, as required.

Although the description and the claims mention socks, the invention is not limited to them; rather, the term socks also subsumes the expressions hose, panty hose and similar terms, to which the invention relates as well. Here, the distancing cushions do not necessarily have to extend from the heel area to the band.

The invention claimed is:

1. A sock, particularly for use in sports activities, which comprises a foot part and a shaft, said foot part including a toe area, a heel area, and a step area located between the toe area and the heel area and cushioning in an area of a wearer's Achilles tendon for absorbing frictional and impact stresses without force being applied to the Achilles tendon, and which is formed from at least two elongated, vertically spaced apart cushions, in which a respective, substantially horizontally extending joint (25) is formed from the material of the heel area between the cushions (24), the cushions (24) being constructed and arranged in a bent shape and being bent in the direction of the heel area (12) and the outermost ends for the cushions (24) being bent down in the direction of the heel area (12), into an area which is located under the highest point of the adjacent cushions (24), the cushions (24) being of different widths, and the cushion (24) which is adjacent to the heel having the largest dimensions of all the cushions (24).

2. A sock, according to claim 1, characterized in that the shapes of the cushions are adapted to the anatomic shape of the foot in the area of the Achilles tendon.

3. A sock, according to claim 2, characterized in that the cushions (24) are made of hollow chamber fibers, around which wool or cotton is spun.

4. A sock, according to claim 2, characterized in that the sock presents additional cushions (22).

5. A sock, according to claim 1, characterized in that the cushions (24) are made of hollow chamber fibers, around which wool or cotton is spun.

6. A sock, according to claim 1, characterized in that the sock presents additional cushions (22).

7. A sock, according to claim 5, characterized in that the sock presents additional cushions (22).

* * * * *